US006889661B2

(12) United States Patent
Duplat et al.

(10) Patent No.: US 6,889,661 B2
(45) Date of Patent: May 10, 2005

(54) FUEL INJECTION SYSTEM FOR AN INTERNAL COMBUSTION ENGINE

(75) Inventors: Gérard Duplat, Vaugneray (FR); Raphael Pourret, Lyons (FR); Peter Voigt, Lyons (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/311,847

(22) PCT Filed: Apr. 12, 2002

(86) PCT No.: PCT/DE02/01367

§ 371 (c)(1),
(2), (4) Date: Oct. 21, 2003

(87) PCT Pub. No.: WO02/086305

PCT Pub. Date: Oct. 31, 2002

(65) Prior Publication Data

US 2004/0025840 A1 Feb. 12, 2004

(30) Foreign Application Priority Data

Apr. 21, 2001 (DE) ..... 101 19 603

(51) Int. Cl.[7] ..... F02M 37/04
(52) U.S. Cl. ..... 123/467; 239/88; 239/96
(58) Field of Search ..... 123/467, 496; 239/88–96

(56) References Cited

U.S. PATENT DOCUMENTS 4,750,462 A * 6/1988 Egler et al. ..... 123/467
5,533,481 A * 7/1996 Kronberger ..... 123/299
6,575,140 B2 * 6/2003 Boecking ..... 123/467
2004/0099250 A1 * 5/2004 Strahbenger et al. ..... 123/467

FOREIGN PATENT DOCUMENTS

DE 3900763 * 7/1990
DE 19940558 * 3/2000
GB 2086473 * 5/1982

* cited by examiner

*Primary Examiner*—Thomas Moulis
(74) *Attorney, Agent, or Firm*—Ronald E. Greigg

(57) ABSTRACT

A fuel injection system having a high-pressure pump and a fuel injection valve for each cylinder of the engine in which the pump has a work chamber, and the injection valve has a valve member movable in an opening direction counter to the force of a closing spring braced between the injection valve member and a displaceable storage piston that is acted upon, on its side remote from the closing spring, by the pressure in the pump work chamber. The storage piston is movable into a storage chamber counter to the force of the closing spring, and the deflection stroke motion of the storage piston is limited by a stop. The storage piston has one shaft portion of smaller cross section, disposed in an outset position in a connecting bore, and one portion of larger cross section disposed outside the connecting bore toward the pump work chamber, and upon the deflection stroke motion of the storage piston into the storage chamber, its shaft portion of larger cross section dips into the connecting bore.

20 Claims, 3 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 02/01367 filed on Apr. 12, 2002.

BACKGROUND OF THE INVENTION

1. Field of the Invention

The invention is directed to an improved fuel injection system for an internal combustion engine.

2. Description of the Prior Art

One fuel injection system of the type with which this invention is concerned, known from German Patent Disclosure DE 39 00 763 A1 has a high-pressure fuel pump and a fuel injection valve for each cylinder of the engine. The high-pressure fuel pump has an engine-driven pump piston defining a pump work chamber, and a communication of the pump work chamber with a relief chamber is controlled by an electrically controlled valve. The fuel injection valve has an injection valve member, by which at least one injection opening is controlled, and which is movable in an opening direction, counter to the force of a closing spring, by the pressure prevailing in a pressure chamber that communicates with the pump work chamber. The closing spring is braced on one end at least indirectly on the injection valve member and on the other at least indirectly on a storage piston. The storage piston, on its side remote from the closing spring, is subjected to the pressure in the pump work chamber and is movable in a stroke motion counter to the force of the closing spring. The storage piston is movable from an outset position, at low pressure in the pressure chamber, into the storage chamber, and the deflection stroke motion of the storage piston into the storage chamber is limited by a stop. The storage piston has a shaft part, guided in a connecting bore between the storage chamber and the pump work chamber, and outside the connecting bore in the storage chamber, it has a larger cross section than on the shaft part. By means of a throttling gap located between the connecting bore and the shaft part, damping of the deflection stroke motion of the pump piston is accomplished, since here fuel positively displaced from the pump work chamber into the storage chamber has the pass through the throttling gap, which causes damping of the motion of the storage piston. The damping of the motion of the storage piston can either be constant over the stroke of the storage piston or such that the damping is strong at the onset of the deflection stroke motion and then decreases. It has been found that the damping attained in this way is insufficient, and thus the storage piston strikes the stop at high speed, causing irritating noises.

SUMMARY OF THE INVENTION

The fuel injection system of the invention has the advantage over the prior art that because of how the storage piston with the shaft part is embodied, with the shaft portion of smaller cross section disposed in the connecting bore in the closing position of the storage piston and the shaft portion of larger cross section dipping into the connecting bore upon the deflection stroke motion, the damping is less of the motion of the storage piston at the onset of the deflection stroke motion and is stronger as the deflection stroke motion increases, so that the storage piston strikes the stop at only slight speed, causing only reduced irritating noise, if any.

Other advantageous features and refinements of the fuel injection system of the invention are disclosed. One embodiment makes stronger damping possible that becomes effective only after a partial deflection stroke of the storage piston. Another embodiment makes it possible to further reduce the speed with which the storage piston strikes the stop, since the effective cross-sectional area of the storage piston upon which the pressure in the pump work chamber acts is reduced when the shaft portion having the larger cross section dips into the connecting bore 56.

BRIEF DESCRIPTION OF THE DRAWINGS

One exemplary embodiment of the invention is described in further detail herein below, with reference to the drawings, in which.

DESCRIPTION OF THE PREFERRED EMBODIMENT

Figure 1:
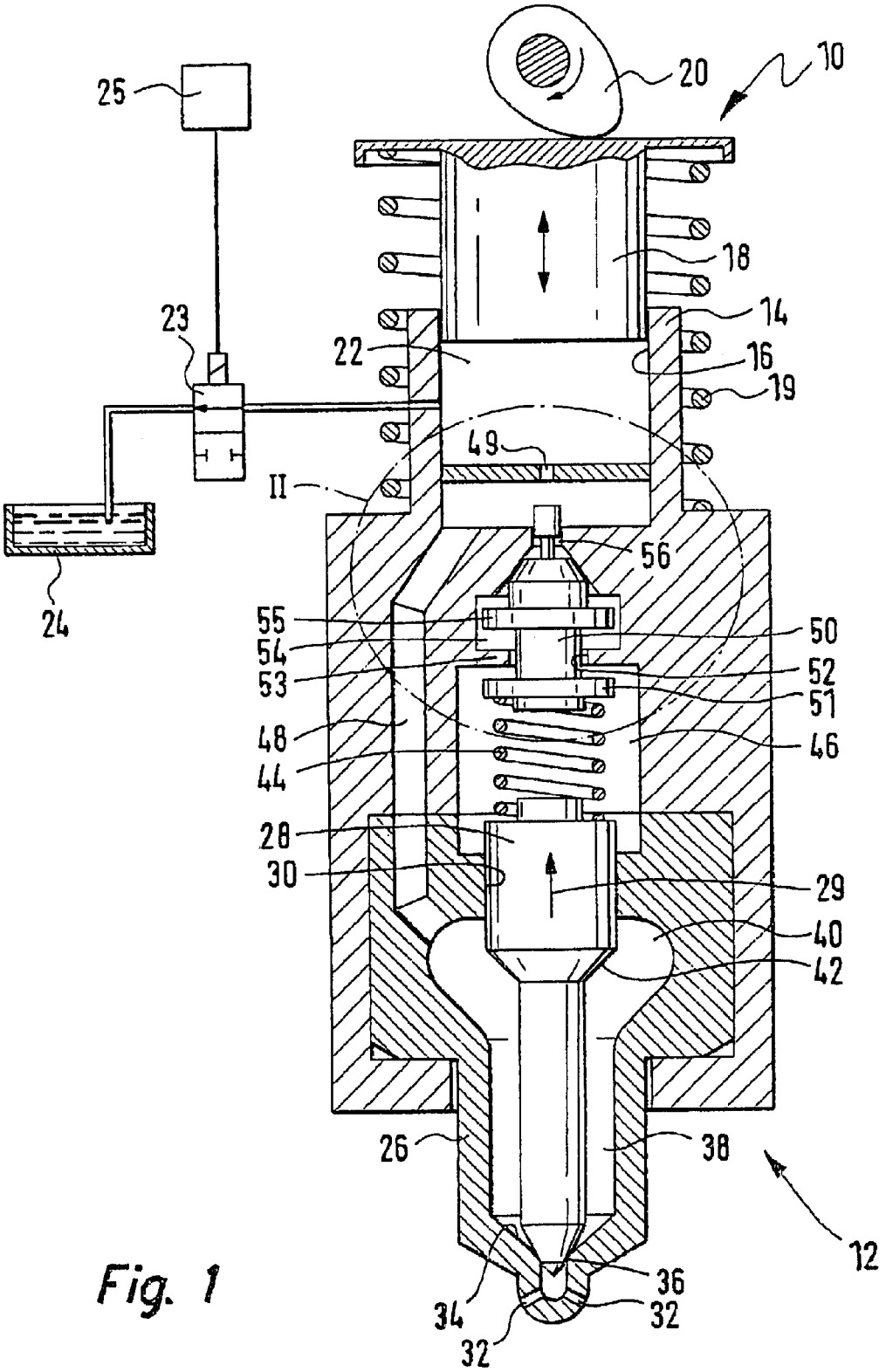
FIG. 1 shows a fuel injection system for an internal combustion engine in a simplified schematic illustration.
Figure 2:
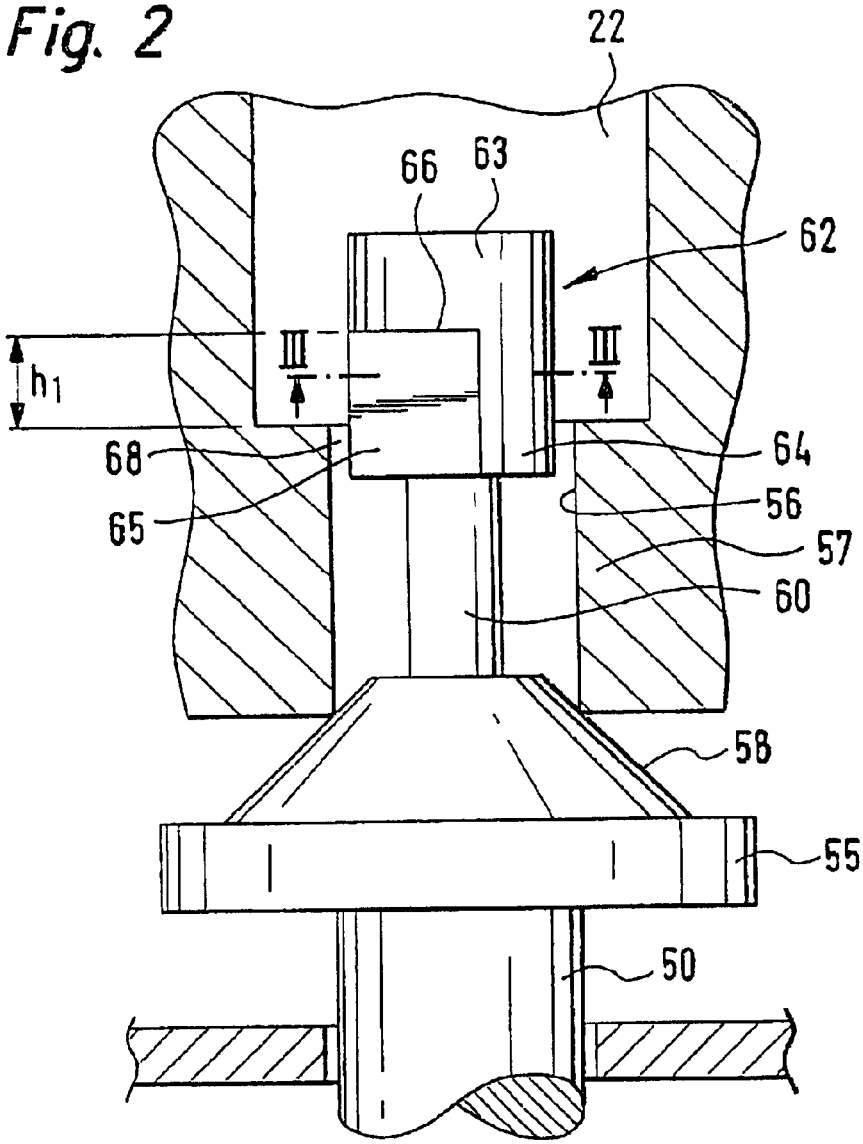
FIG. 2 shows a detail marked II in FIG. 1 on a larger scale, with a storage piston in an outset position.
Figure 3:
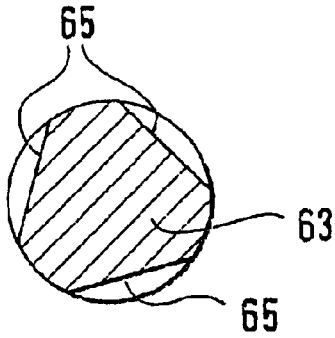
FIG. 3 shows the storage piston in a cross section taken along the line III—III in FIG. 2.

In FIGS. 1–3, a fuel injection system for an internal combustion engine of a motor vehicle is shown. The engine has one or more cylinders, and for each cylinder there is one fuel injection system, with a high-pressure fuel pump 10 and a fuel injection valve 12. The high-pressure fuel pump 10 and the fuel injection valve 12 are combined into a so-called unit fuel injector. The high-pressure fuel pump 10 has a pump body 14, in which a pump piston 18 is guided tightly in a cylinder 16; the pump piston is driven in a stroke motion by a cam 20 of a camshaft of the engine, counter to the force of a restoring spring 19. In the cylinder 16, the pump piston 18 defines a pump work chamber 22, in which fuel is compressed at high pressure in the pumping stroke of the pump piston 18. In the intake stroke of the pump piston 18, fuel from a fuel tank 24 is delivered to the pump work chamber, for instance by means of a feed pump. The pump work chamber 22 has a communication with a relief chamber such as the fuel tank 24, and which is controlled by an electrically controlled valve 23. The electrically controlled valve 23 is connected to a control unit 25.

The fuel injection valve 12 has a valve body 26, which can be embodied in multiple parts and is connected to the pump body 14. In the valve body 26, an injection valve member 28 is guided longitudinally displaceably in a bore 30. The bore 30 extends at least approximately parallel to the cylinder 16 of the pump body 14 but can also extend at an incline to it. The valve body 26, in its end region toward the combustion chamber of the cylinder of the engine, has at least one and preferably more injection openings 32. The injection valve member 28, in its end region toward the combustion chamber, has a sealing face 34, which for instance is approximately conical, and which cooperates with a valve seat 36, for instance also approximately conically, embodied in the valve body 26, in its end region toward the combustion chamber, and from the valve seat or downstream of it, the injection openings 32 lead away.

In the valve body 26, between the injection valve member 28 and the bore 30, toward the valve seat 36, there is an annular chamber 38, which in its end region remote from the valve seat 36 changes over, by means of a radial enlargement of the bore 30, into a pressure chamber 40 surrounding the injection valve member 28. At the level of the pressure chamber 40, as a result of a cross-sectional reduction, the injection valve member 28 has a pressure shoulder 42 pointing toward the valve seat 36. The end of the injection valve member 28 remote from the combustion chamber is engaged by a prestressed closing spring 44, by which the injection valve member 28 is pressed toward the valve seat 36. The closing spring 44 is disposed in a spring chamber 46, which adjoins the bore 30. The pressure chamber 40 communicates with the pump work chamber 22 via a conduit 48 extending through the valve body 26 and the pump body 14.

The closing spring 44 is braced on one end, at least indirectly, for instance via a spring plate, on the injection valve member 28 and on the other end, at least indirectly, for instance also via a spring plate 51, on a storage piston 50. The storage piston 50 is disposed with its end region toward the closing spring 44 in the spring chamber 46 and protrudes into a storage chamber 54, through a bore 52 in a partition 53 between the storage chamber 54 and the spring chamber 46. The bore 52 has a smaller diameter than the spring chamber 46 and the storage chamber 54. In the storage chamber 54, the storage piston 50 has one region 55 with a larger diameter than the bore 52, so that a stroke motion of the storage piston 50 into the spring chamber 46 is limited by the fact that the region 55 of the storage piston 50 comes to rest against the partition 53, as a stop.

From the storage chamber 54, from its end remote from the spring chamber 46, a connecting bore 56 leads to the pump work chamber 22 through a partition 57. The connecting bore 56 has a smaller diameter than the region 55 of the storage piston 50. Toward the connecting bore 56, adjoining the region 55, the storage piston 50 has a sealing face 58, which is for instance embodied approximately conically. The sealing face 58 cooperates with the orifice of the connecting bore 56 into the storage chamber 54 at the partition 57 as a seat, which can likewise be approximately conical. The storage piston 50 has a shaft 60, which protrudes into the connecting bore 56 and whose diameter is less than that of the region 55. Adjoining the sealing face 58, the shaft 60 initially has a substantially smaller diameter than the connecting bore 56, and adjoining that, toward its free end, it has a shaft part 62 with a diameter that is only slightly smaller than the diameter of the connecting bore 56.

The shaft part 62 is divided into a shaft portion 63 of larger cross section, disposed toward the free end, and a shaft portion 64 of smaller cross section, disposed toward the shaft 60. The shaft portion 63 of larger cross section for instance has an at least approximately circular cross section and is embodied circular-cylindrically. The shaft portion 64 of smaller cross section can likewise have an at least approximately circular cross section, but with a smaller diameter than the shaft portion 63, and is embodied circular-cylindrically. Preferably, the smaller cross section of the shaft portion 64 is formed from the shaft portion 63 by means of at least one flat face 65. There may be only one, two, three or more flat faces 65 distributed over the circumference of the shaft portion 64. Between the flat faces 65, the full diameter of the shaft portion 63 is preferably present, so that the shaft portion 64 is likewise guided in the connecting bore 56. In the production of the shaft portions 63, 64, a circular-cylindrical shaft part can be the starting point, which continuously has the diameter of the shaft portion 63, and on which the flat faces 65 are embodied in order to form the shaft portion 64 having the smaller cross section. At the transition to the shaft portion 63, at the jacket of the shaft portion 63, the flat faces 65 end in control edges 66.

If the storage piston 50 is in its outset position, in which it rests with its sealing face 58 on the partition 57 at the orifice of the connecting bore 56, the storage chamber 54 is disconnected from the pump work chamber 22. In the outset position of the storage piston 50, the shaft portion 64 is disposed in the connecting bore 56, and its shaft portion 63 is disposed outside the connecting bore 56, toward the pump work chamber 22. The pressure prevailing in the pump work chamber 22 acts on the end face of the shaft portion 63 and, via a gap 68 between the circumference of the shaft portion 64 and the connecting bore 56, on the sealing face 58 of the storage piston 50 in accordance with the diameter of the connecting bore 58. By the force of the closing spring 44, the storage piston 50 is kept in its outset position, counter to the pressure prevailing in the pump work chamber 22, if the force exerted on the storage piston 50 by the pressure in the pump work chamber 22 is less than the force of the closing spring 44. The storage piston 50 is shown in FIG. 2 in its outset position.

Figure 4:
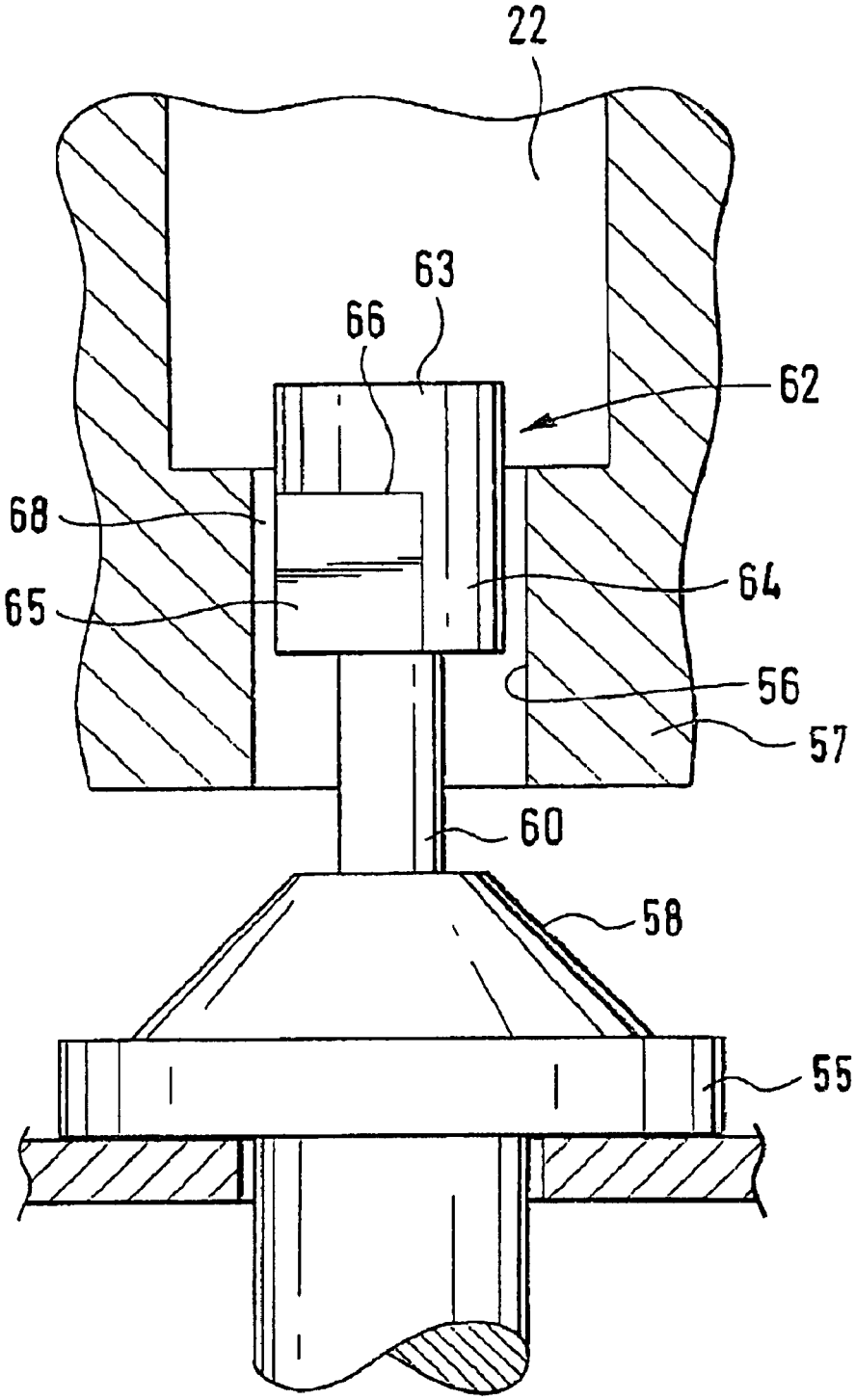
FIG. 4 shows the detail II with the storage piston in a deflected position.

If the pressure in the pump work chamber 22 rises so sharply that the force exerted on the storage piston 50 is greater than the force of the closing spring 44, then the storage piston 50 moves in a deflecting motion out of the pump work chamber 22 into the storage chamber 54. In the deflection motion of the storage piston 50, fuel is positively displaced out of pump work chamber 22 into the storage chamber 54; this fuel must pass through the gap 68 between the shaft portion 64 of the storage piston 50 and the connecting bore 56. As a result, damping of the deflection motion of the storage piston 50 is attained. Once the storage piston 50, with its sealing face 58, has lifted from the orifice of the connecting bore 56 at the partition 57, the larger-diameter region 55 of the storage piston 50 is acted upon by the pressure prevailing in the pump work chamber 22, reduced by the pressure losses upon throttling through the gap 68, so that a greater force acts on the storage piston 50 counter to the closing spring 44. The shaft portion 64 of the shaft 60 with the larger cross section is, at the onset of the deflection motion of the storage piston 50, disposed outside the connecting bore 56. After a partial deflection stroke h1 of the storage piston 50, the shaft portion 63 dips into the connecting bore 56; between this shaft portion and the connecting bore 56, only a very small gap 68 now remains, so that only a slight pressure now acts on the region 55 of the storage piston 50, and the pressure in the pump work chamber 22 now acts only on the end face of the shaft portion 63. As a result, the deflection stroke motion of the storage piston 50 is strongly damped, so that the storage piston, with its region 55, strikes the partition 53, which forms a stop to limit the deflection stroke motion of the storage piston 50, at only a slight speed. In FIG. 4, the storage piston 50 is shown with its maximum deflection stroke.

A throttle restriction 49 may be provided in the communication of the pressure chamber 40 with the pump work chamber 22 via the conduit 48. The throttle restriction 49 may also be omitted, in which case the pressure chamber 40 has an unthrottled communication with the pump work chamber 22. The communication of the connecting bore 56, in which the shaft part 62 of the storage piston 50 is disposed, is likewise effected via the throttle restriction 49. It can also be provided that the pressure chamber 40 has an unthrottled communication with the pump work chamber 22, and the connecting bore 56 communicates with the pump work chamber 22 via the throttle restriction 49.

The function of the fuel injection system will now be explained. The pump work chamber 22 is filled with fuel during the intake stroke of the pump piston 18. In the pumping stroke of the pump piston 18, the control valve 23 is open at first, and thus high pressure cannot build up in the pump work chamber 22. When the fuel injection is to begin, the control valve 23 is closed by the control unit 25, so that the pump work chamber 22 is disconnected from the fuel tank 24, and high pressure builds up in it. Once the pressure in the pump work chamber 22 and in the pressure chamber 40 is so high that the force acting in the opening direction 29 on the injection valve member 28 via the pressure shoulder is greater than the force of the closing spring 44, the injection valve member 28 moves in the opening direction 29 and uncovers the at least one injection opening 32, through which fuel is injected into the combustion chamber of the cylinder. The storage piston 50 is in its outset position at this time. The pressure in the pump work chamber 22 subsequently increases further, in accordance with the profile of the cam 20.

When the force exerted on the storage piston 50 by the pressure prevailing in the pump work chamber 22 becomes greater than the force exerted on the storage piston 50 by the closing spring 44, the storage piston 50 executes its deflection stroke motion and moves into the storage chamber 54. This causes a pressure drop in the pump work chamber 22 and also increases the prestressing of the closing spring 44, which is braced on the storage piston 50. As a result of the pressure drop in the pump work chamber 22 and in the pressure chamber 40, there is a lesser force on the injection valve member 28 in the opening direction 29. and because of the increase in the prestressing of the closing spring 44 there is an increased force in the closing direction on the injection valve member 28, so that the injection valve member is moved in the closing direction again, comes to rest with its sealing face 34 on the valve seat 36, and closes the injection openings 32, so that the fuel injection is interrupted. The fuel injection valve 12 is opened for only a brief time, and only a slight quantity of fuel is injected as a preinjection into the combustion chamber. The injected fuel quantity is determined essentially by the opening pressure of the storage piston 50, which is the pressure in the pump work chamber 22 at which the storage piston 50 begins its deflection stroke motion. The opening stroke of the injection valve member 28 during the preinjection can be limited hydraulically by a damping device. One such damping device is known from DE 39 00 762 A1 and the corresponding U.S. Pat. No. 5,125,580, as well as DE 39 00 763 A1 and the corresponding U.S. Pat. No. 5,125,581, which are hereby incorporated by reference into the present patent application.

The pressure in the pump work chamber 22 subsequently increases further, in accordance with the profile of the cam 20, so that the pressure force acting on the injection valve member 28 in the opening direction 29 increases again and exceeds the closing force that has been increased because of the increased prestressing of the closing spring 44, and so the fuel injection valve 12 opens again. Now a larger quantity of fuel is injected over a longer period of time than during the preinjection. The duration and the fuel quantity injected during this main injection are determined by the instant at which the control valve 23 is opened again by the control unit 25. After the opening of the control valve 23, the pump work chamber 22 again communicates with the fuel tank 24 and is thus relieved, and the fuel injection valve 12 closes. The storage piston 50 is moved back into its outset position again by the force of the closing spring 44. The chronological offset between the preinjection and the main injection is determined primarily by the deflection stroke of the storage piston 50.

The foregoing relates to preferred exemplary embodiments of the invention, it being understood that other variants and embodiments are possible within the spirit and scope of the Invention, the latter being defined by the appended claims.

What is claimed is:

1. In a fuel injection system for an internal combustion engine, having a high-pressure fuel pump (10) and a fuel injection valve (12) for a cylinder of the engine, wherein the high-pressure fuel pump (10) has a pump piston (18), driven by the engine and defining a pump work chamber (22), and having an electrically controlled valve (23) by which a connection of the pump work chamber (22) with a relief chamber (24) is controlled, the fuel injection valve (12) having an injection valve member (28) by which at least one injection opening (32) is controlled, and which is movable in an opening direction (29), counter to the force of a closing spring (44), by the pressure prevailing in a pressure chamber (40) communicating with the pump work chamber (22), the closing spring (44) being braced on one end at least indirectly on the injection valve member (28) and on the other ending at least indirectly on a displaceable storage piston (50) that is acted upon, on its side remote from the closing spring (44), by the pressure prevailing in the pump work chamber (22), the storage piston (50) being movable, beginning at an outset position, counter to the force of the closing spring (44) into a storage chamber (54), and the deflection stroke motion of the storage piston (50) into the storage chamber (54) is limited by a stop (53), and the storage piston (50) has a shaft part (62), guided in a connecting bore (53) between the storage chamber (54) and a pump work chamber (22), and a region (55), disposed in the storage chamber (54), of larger cross section than the shaft part (62), and damping of the stroke motion of the storage piston (50) is effected by means of a gap (68) existing between the shaft part (62) and the connecting bore (56), the improvement wherein the shaft part (62) of the storage piston (50) has one shaft portion (64) of smaller cross section, disposed in its outset position in the connecting bore (56), and one shaft portion (63) of larger cross section, disposed outside the connecting bore (56) toward the pump work chamber (22); and wherein in the deflection stroke motion of the storage piston (50) into the storage chamber (54), the shaft portion (63) of larger cross section dips into the connecting bore (56).

2. The fuel injection system of claim 1, wherein the shaft portion (63) of larger cross section does not dip into the connecting bore (56) until after a partial deflection stroke (h1) of the storage piston (50).

3. The fuel injection system of claim 1, wherein in the deflection stroke motion of the storage piston (50), as long as the shaft portion (63) of larger cross section is disposed outside the connecting bore (56), the region (55) of the storage piston (50) disposed in the storage chamber (54) is subjected to pressure; and wherein when the shaft portion (64) of larger cross section dips into the connecting bore (56), only the cross-sectional area of the larger shaft portion is now subjected to the pressure in the pump work chamber (22).

4. The fuel injection system of claim 2, wherein in the deflection stroke motion of the storage piston (50), as long as the shaft portion (63) of larger cross section is disposed outside the connecting bore (56), the region (55) of the storage piston (50) disposed in the storage chamber (54) is subjected to pressure; and wherein when the shaft portion (64) of larger cross section dips into the connecting bore (56), only the cross-sectional area of the larger shaft portion is now subjected to the pressure in the pump work chamber (22).

5. The fuel injection system of claim 1, wherein the transition from the shaft portion (63) of larger cross section of the storage piston (50) to the shaft portion (64) of smaller cross section takes place in a control edge (66) that ends at the jacket of the shaft part (62).

6. The fuel injection system of claim 2, wherein the transition from the shaft portion (63) of larger cross section of the storage piston (50) to the shaft portion (64) of smaller cross section takes place in a control edge (66) that ends at the jacket of the shaft part (62).

7. The fuel injection system of claim 3, wherein the transition from the shaft portion (63) of larger cross section of the storage piston (50) to the shaft portion (64) of smaller cross section takes place in a control edge (66) that ends at the jacket of the shaft part (62).

8. The fuel injection system of claim 4, wherein the transition from the shaft portion (63) of larger cross section of the storage piston (50) to the shaft portion (64) of smaller cross section takes place in a control edge (66) that ends at the jacket of the shaft part (62).

9. The fuel injection system of claim 1, wherein the shaft portion (64) of smaller cross section of the storage piston (50) is formed, beginning at the shaft portion (63) of larger cross section, by at least one flat face (65) on the circumference of the shaft part (62).

10. The fuel injection system of claim 2, wherein the shaft portion (64) of smaller cross section of the storage piston (50) is formed, beginning at the shaft portion (63) of larger cross section, by at least one flat face (65) on the circumference of the shaft part (62).

11. The fuel injection system of claim 3, wherein the shaft portion (64) of smaller cross section of the storage piston (50) is formed, beginning at the shaft portion (63) of larger cross section, by at least one flat face (65) on the circumference of the shaft part (62).

12. The fuel injection system of claim 4, wherein the shaft portion (64) of smaller cross section of the storage piston (50) is formed, beginning at the shaft portion (63) of larger cross section, by at least one flat face (65) on the circumference of the shaft part (62).

13. The fuel injection system of claim 5, wherein the shaft portion (64) of smaller cross section of the storage piston (50) is formed, beginning at the shaft portion (63) of larger cross section, by at least one flat face (65) on the circumference of the shaft part (62).

14. The fuel injection system of claim 6, wherein the shaft portion (64) of smaller cross section of the storage piston (50) is formed, beginning at the shaft portion (63) of larger cross section, by at least one flat face (65) on the circumference of the shaft part (62).

15. The fuel injection system of claim 7, wherein the shaft portion (64) of smaller cross section of the storage piston (50) is formed, beginning at the shaft portion (63) of larger cross section, by at least one flat face (65) on the circumference of the shaft part (62).

16. The fuel injection system of claim 8, wherein the shaft portion (64) of smaller cross section of the storage piston (50) is formed, beginning at the shaft portion (63) of larger cross section, by at least one flat face (65) on the circumference of the shaft part (62).

17. The fuel injection system of claim 9, wherein the shaft portion (63) of larger cross section of the storage piston (50) is embodied as at least approximately circular-cylindrical.

18. The fuel injection system of claim 2, wherein the shaft portion (63) of larger cross section of the storage piston (50) is embodied as at least approximately circular-cylindrical.

19. The fuel injection system of claim 3, wherein the shaft portion (63) of larger cross section of the storage piston (50) is embodied as at least approximately circular-cylindrical.

20. The fuel injection system of claim 4, wherein the shaft portion (63) of larger cross section of the storage piston (50) is embodied as at least approximately circular-cylindrical.

* * * * *